US008701744B2

(12) United States Patent
Takasu et al.

(10) Patent No.: US 8,701,744 B2
(45) **Date of Patent: *Apr. 22, 2014**

(54) MOLDING MACHINE

(75) Inventors: Shuji Takasu, Toyokawa (JP); Yutaka Hadano, Toyokawa (JP); Takayuki Komiyama, Toyokawa (JP); Takuya Nitta, Toyokawa (JP); Shuichi Tsuzuki, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/060,879

(22) PCT Filed: Jun. 3, 2010

(86) PCT No.: PCT/JP2010/059439

§ 371 (c)(1),
(2), (4) Date: Feb. 25, 2011

(87) PCT Pub. No.: WO2011/111241

PCT Pub. Date: Sep. 15, 2011

(65) Prior Publication Data

US 2012/0328727 A1 Dec. 27, 2012

(30) Foreign Application Priority Data

Mar. 11, 2010 (JP) ..... 2010-053917

(51) Int. Cl.
*B22C 15/24* (2006.01)

(52) U.S. Cl.
USPC ..... 164/200; 164/202; 164/19; 164/20

(58) Field of Classification Search
USPC ..... 164/19–22, 200–202
See application file for complete search history.

(56) References Cited

U.S. PATENT DOCUMENTS

| | | | | |
|---|---|---|---|---|
| 6,752,196 | B2 * | 6/2004 | Kaneto et al. | 164/20 |
| 2008/0169083 | A1 | 7/2008 | Harada et al. | |
| 2009/0145573 | A1 * | 6/2009 | Hirata et al. | 164/180 |

FOREIGN PATENT DOCUMENTS

| | | |
|---|---|---|
| CN | 101568147 | 11/2009 |
| CN | 101862815 | 10/2010 |

(Continued)

OTHER PUBLICATIONS

PTO translation of JP 43002181 B, Mar. 2013.*

(Continued)

*Primary Examiner* — Keith Walker
*Assistant Examiner* — Kevin E Yoon
(74) *Attorney, Agent, or Firm* — Finnegan, Henderson, Farabow, Garrett & Dunner, L.L.P.

(57) ABSTRACT

A molding machine which allows a simplification of a sand filling operation, and the prevention of the formation of a bridge and an air channel in the sand tank, so that the sand filling operation of the molding machine is able to be performed steadily. The molding machine of the present invention includes: a sand tank for storing molding sand to be introduced to a molding flask; a pair of upper and lower sand filling nozzles to guide the molding sand in a horizontal direction, where the molding sand is supplied from a pair of upper and lower sand introducing parts which are located at the lower part of the sand tank; and at least one filter part with a plurality of air-injecting apertures on its entire body, which is attached to at least the entire inner surfaces of the pair of sand introducing parts; wherein the molding sand is fluidized by air injected through the air-injecting apertures of the filter part, and introduced to the molding flask through the sand filling nozzles.

12 Claims, 5 Drawing Sheets

(56) References Cited

FOREIGN PATENT DOCUMENTS

| | | | | |
|---|---|---|---|---|
| EP | 0 779 118 | A1 | | 6/1997 |
| GB | 2 057 319 | | | 4/1981 |
| JP | 43002181 | B | * | 1/1968 |
| JP | 58-68453 | | | 4/1983 |
| JP | 59-24552 | | | 2/1984 |
| JP | 61-138451 | U | | 8/1986 |
| JP | 63303651 | A | * | 12/1988 |
| JP | 03114312 | U | * | 11/1991 |
| JP | 5-337605 | | | 12/1993 |
| JP | 10-216902 | | | 8/1998 |
| WO | WO 2008/087772 | A1 | | 7/2008 |
| WO | WO 2011/086711 | A1 | | 7/2011 |

OTHER PUBLICATIONS

PTO translation of JP 03114312 U, Feb. 2013.*

International Search Report dated Aug. 3, 2010.

European Patent Office, Supplementary European Search Report issued in corresponding Application No. EP 10 80 8962, dated Mar. 13, 2012, 2 pages.

* cited by examiner

MOLDING MACHINE

TECHNICAL FIELD

The present invention relates to a molding machine for producing molds which are made of molding sand.

BACKGROUND ART

Molding machines for producing molds are well known in the art. There is a type of molding machine which introduces molding sand to a molding flask, which generally comprises a pair of an upper and a lower flask, through the sidewall of the molding flask in a horizontal direction (see Patent Document 1). This type of molding machine is superior to another type of molding machine, which introduces molding sand from the top of the molding flask, in the way that the machine which introduces molding sand through the sidewall of the molding flask allows the elimination of a step to turn around the molding flask after the steps of introducing and squeezing the molding sand.

However, in the case of the molding machine which introduces molding sand through the sidewall of the molding flask in a horizontal direction, the molding sand stored in a sand tank descends along the direction of gravity, and then its direction turns by 90 degrees, to the horizontal direction. In this process, a stagnant part of the molding sand may be formed in the sand tank due to the change in the direction the sand flows. After a certain period of molding operations, the stagnant part of the molding sand may cause a formation of a bridge in the sand tank as illustrated in FIG. 5. When the bridge is formed in the sand tank, the operation of the molding machine will be interrupted due to the need for cleaning the inside of the sand tank 202. The letter "S" in FIGS. 5 and 6 denotes the molding sand.

Even when a bridge is not formed in the sand tank, if the rate of introducing the molding sand to the pair of the upper and the lower flask are not equal, the descending rate of the level of the sand in the sand tank would become uneven. As the result, an air channel would be formed in the sand tank, as illustrated in FIG. 6.

Patent Document 2 discloses a so called Top-Under Blowing molding machine, which has air-inlet nozzles in addition to valves at the horizontal and bent parts of upper and lower blowing-heads for introducing molding sand into the molding flask.

Patent Literature

[PTL 1]
Japanese Patent Laid-open Publication No. S58-68453
[PTL 2]
Japanese Patent Laid-open Publication No. H10-216902

SUMMARY OF INVENTION

Technical Problem

However, as to the molding machine which introduces molding sand to the molding flask in a horizontal direction, the formation of the bridge and the air channel in the sand tank may not be prevented by only providing air-inlet nozzles. Also, when the pressure of the air is 0.2-0.35 MPa or more, which is common for conventional molding machines, the molding sand tends to be packed at the lips of the air-inlet nozzles. Further, the amount of air consumed will increase.

Solution to Problem

The present invention aims to provide a molding machine which eliminates the need to turn around the molding flask after the step of squeezing molding sand, and prevents the formation of the bridge and the air channel in the sand tank, so as to be able to perform the sand filling operation of the molding machine steadily, i.e., without interruption.

The molding machine of the present invention comprises a sand tank for storing molding sand to be introduced to a molding flask, a pair of upper and lower sand filling nozzles to guide the molding sand to a horizontal direction, where the molding sand is supplied from a pair of upper and lower sand introducing parts which are located at the lower part of the sand tank, and at least one filter part with a plurality of air-injecting apertures on its entire body, which is attached to at least all inner surfaces of the pair of sand introducing parts, wherein the molding sand in the sand tank is fluidized by air injected through the air-injecting apertures of the filter part, and introduced to the molding flask through the sand filling nozzles.

In some embodiments of the molding machine, the filter part may comprise a porous member which has a plurality of air-injecting apertures with pore diameters ranging from 10 μm to 80 μm.

In some embodiments, the pressure of the air to be injected through the air-injecting apertures of the porous material is 0.05 MPa to 0.18 MPa.

In some embodiments, the filter part is attached to the inner sidewall of the sand tank and the inner walls of the pair of sand introducing parts, wherein the area to attach the filter part is 50% to 100% of the total area of the inner sidewall of the sand tank and the inner walls of the pair of sand introducing parts.

In another embodiment, the filter part is attached to the inner sidewall of the sand tank and the inner walls of the pair of sand introducing parts, wherein the area to attach the filter part is 70% to 100% of the total area of the inner sidewall of the sand tank and the inner walls of the pair of sand introducing parts.

In some embodiments, the volume of the upper part of the sand tank, which is above the pair of sand introducing parts, is 1.5 times or less of the volume of the molding sand which is introduced to the molding flask.

In another embodiment, the amount of the molding sand introduced to the molding flask from the upper sand filling nozzle is 1.5 times or more the amount of the molding sand which is introduced to the molding flask from the lower sand filling nozzle.

In some embodiments, the cross-sectional shape of the sand tank is either rectangular or square.

In some embodiments, the molding machine has an air-control valve which is connected to a space formed between the inner surface of the sand tank and the porous member. The air-control valve is to control both the charging and discharging of compressed air to the space.

In some embodiments, the molding machine has the following: sealing members which are attached to the lips of the sand filling nozzles and inflated by compressed air supplied to the inner cavities of the sealing members; and on-off valves which are connected to both the air-control valve and the inner cavities of the sealing members.

In another embodiment, the molding machine may have speed control valves which are installed between the on-off valves and the air-control valve, and between the on-off valves and the inner cavities of the sealing members.

Further, the molding machine is to mold flaskless upper and lower molds made of molding sand, wherein the machine comprises the following:

a lower squeeze board which is movable up and down;

a lower filling frame which is movable up and down independently of but simultaneously with the lower squeeze board, and provided with a sand introducing hole formed on the sidewall thereof, an upper squeeze board which is located above the lower squeeze board and opposing the lower squeeze board;

a cope flask which is movable up and down and provided with a sand introducing hole formed on the sidewall thereof;

a drag flask which is provided with a match plate on the top of it, and movable to and from an intermediate position between the upper and lower squeeze boards; and a lower squeeze frame which is integrated with the lower squeeze board and movable up and down along two or more columns.

In some embodiments, the lower filling frame is mounted on distal ends of rods of two or more lower filling frame cylinders which are fixed on the lower squeeze frame in an upward direction.

In some embodiments, the lower squeeze board is moved up and down by an air-on-oil.

In some embodiments, the lower filling frame is moved up and down by a pneumatic or an electrical driving force.

In some embodiments, the cope flask is moved up and down by an actuator, when a molded sand mold is stripped off from the cope flask.

Advantageous Effects of Invention

In one aspect, the molding machine of the present invention is provided with the pair of upper and lower sand filling nozzles at the lower part of the sand tank, for guiding molding sand supplied from the pair of upper and lower sand introducing parts to a horizontal direction. Further, the molding machine is provided with a filter part having a plurality of air-injecting apertures, which is attached to all the inner surfaces of the pair of the sand introducing parts.

Such a construction of the molding machine allows not only the elimination of the step to turn around the molding flask after the steps of introducing and squeezing the molding sand, but also the prevention of the formation of the bridge and the air channel in the sand tank, thereby the sand filling operation of the machine being able to be performed steadily, i.e., without interruption.

In another aspect, the molding machine is provided with the pair of upper and lower sand filling nozzles at the lower part of the sand tank, for guiding molding sand supplied from the pair of upper and lower sand introducing parts in a horizontal direction. Further, the molding machine is provided with porous members (as the filter part) which have a plurality of air-injecting apertures with pore diameters ranging from 10 μm to 80 μm. The porous members are attached to the inner sidewall of the sand tank and the inner walls of the pair of sand introducing parts, wherein the area to attach the porous member is 70% to 100% of the total area of the inner sidewall of the sand tank and the inner walls of the pair of sand introducing parts.

Such a construction of the molding machine enables not only the elimination of the step to turn around the molding flask after introducing and squeezing the molding sand, but also the prevention of the formation of a bridge and an air channel in the sand tank, thereby the sand filling operation of the machine being able to be performed steadily.

DESCRIPTION OF EMBODIMENTS

Figure 1:
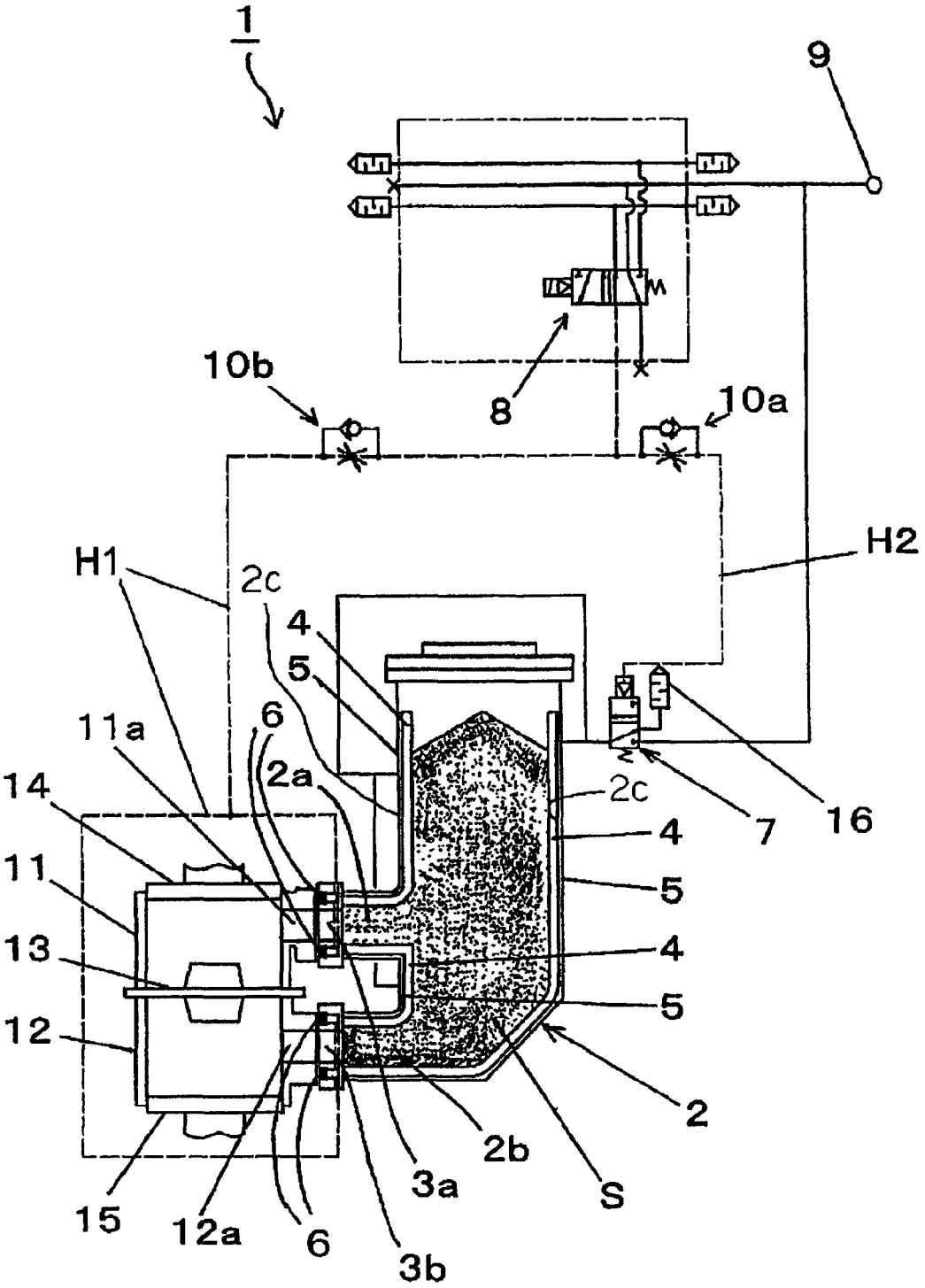
FIG. 1 illustrates an arrangement of the sand tank of the molding machine and associated facilities thereof, according to an embodiment of the present invention.

The molding machine of the present invention is described below by reference to FIGS. 1-6. FIG. 1 illustrates an arrangement of the sand tank of the molding machine and associated facilities thereof, according to one embodiment of the present invention The molding machine 1 of the present invention has a sand tank 2 to supply molding sand to a molding flask which comprises a pair of an upper flask 11 and a lower flask 12. The molding machine 1 also has a pair of upper and lower sand filling nozzles 3*a*, 3*b* to guide the molding sand in the horizontal direction. The molding sand is introduced to the pair of sand filling nozzles 3*a*, 3*b* via a pair of upper and lower sand introducing parts 2*a*, 2*b*, which are located at the lower part of the sand tank 2. The sand tank 2 is a cuboid, whose cross sectional shape in a plane perpendicular to the vertical direction is either rectangular or square. The sand tank 2 may possibly be a cylinder whose cross sectional shape is a circle. Since a sand tank whose cross sectional shape is either rectangular or square can store more sand than can a cylindrical tank in relation to a floor area substantially occupied by the tank, the height of the sand tank may be reduced.

The molding machine 1 also has porous members 4 as the filter parts, which have a plurality of air-injecting apertures (not shown in the figures) with pore diameters of 10 μm to 80 μm. The porous members 4 are attached to the inner sidewall 2*c*, and the inner walls of the upper and lower sand introducing parts 2*a*, 2*b*, of the sand tank 2. The pore diameters of the porous members 4 are preferably 10 μm to 80 μm, in light of the performance and the processability of the porous members. However, the pore diameter can be about 200 μm, which is smaller than the particle size of the molding sand. Each porous member 4 is prepared by sintering ultrahigh molecular weight polyethylene, for example. Although the filter part for the molding machine 1 of this embodiment comprises the porous member 4 made of a sintered ultrahigh molecular weight polyethylene, any material which has a plurality of air-injecting apertures on its entire body can be used as the filter part. Exemplary simplified aeration systems are such as slits with openings 0.28-0.40 mm wide which function as the air-injecting apertures, or a filter part which is made of a plate of ultrahigh molecular weight polyethylene having a plurality of 2-mm holes.

The area to attach the porous member 4 is 70% or more (70% to 100%) of the total area of the inner sidewall of the sand tank 2 and the inner walls of the pair of sand introducing parts 2*a*, 2*b*. In FIG. 1, 89% of the total area is covered by the porous member 4. The porous member 4 is attached to the inside of the sand tank 2 from the bottom of the tank, so that the area covered by the porous member 4 reaches 70% or more of the total area. Thus, the upper portion of the sand tank 2 may not be covered by the porous member 4. The porous member 4 covers at least all the inner walls of the pair of sand introducing parts 2*a*, 2*b*. Since the direction the molding sand flows is changed by 90 degrees near the pair of sand filling nozzles 3*a*, 3*b*, a stagnant part of the molding sand tends to be formed near the nozzles. By attaching the porous member 4 to all the inner walls of the pair of sand introducing parts 2*a*, 2*b*, the formation of any stagnant part of the molding sand near the sand filling nozzles can be prevented. Further, by attaching the porous member 4 to from 70% to 100% of the total inner area of the sand tank 2, the formation of any stagnant part of molding sand along the sidewall of the tank can be prevented. In this embodiment, the porous member 4 is attached to 70% to 100% of the total inner area of the sand tank 2, to effectively prevent the formation of any stagnant part of the molding sand. However, to simplify the construction of the molding machine 1, the inner area of the sand tank 2 to which the porous member 4 is to be attached can be altered to, for example, 50% to 100% of the total area of the inner sidewall of the sand tank 2 and the inner walls of the pair of sand introducing parts 2*a*, 2*b*. The porous member 4 is attached to the inner wall of the sand tank 2, but a space is left between them. A chamber 5 is formed between the porous member 4 and the inner wall of the sand tank 2, by sealing the gap between the outer edges of the porous member 4 and the inner wall of the sand tank 2. A sliding gate (not shown) is placed on the top of the sand tank 2.

Sealing members 6, which are inflated by introducing compressed air to the inner cavities thereof, are mounted on the edges of the tips (hereinafter "lips") of the pair of sand filling nozzles 3*a*, 3*b*. An exemplary material for preparing the sealing member 6 is nitrile rubber. The chamber 5 is connected to a piloted on-off valve 7.

A solenoid open/close valve 8 is connected to both the inner cavities of the sealing members 6 and the piloted on-off valve 7. The solenoid open/close valve 8 is connected to a source of compressed air 9. Speed control valves 10*a*, 10*b* are provided between the solenoid open/close valve 8 and the piloted on-off valve 7, and between the solenoid open/close valve 8 and the inner cavities of the sealing members 6, respectively.

In this embodiment, the molding machine 1 is a flaskless molding machine. FIG. 1 illustrates molding spaces which are defined in an upper flask 11 and a lower flask 12 by sandwiching a match plate 13 between the upper flask 11 and the lower flask 12, and by inserting an upper squeeze member 14 and a lower squeeze member 15 into the upper and the lower flasks 11, 12, respectively.

In FIG. 1, the sand filling nozzles 3*a*, 3*b* of the sand tank 2 are in contact with sand inlets 11*a*, 12*a* of the upper and the lower flasks 11, 12, to fill up the upper and the lower flasks 11, 12 with molding sand S stored in the sand tank 2. Examples of the molding sand S include natural sand, artificial sand made of ceramic, etc.

The operation of the sand tank 2 of the molding machine 1 and the associated facilities of the sand tank 2 are as follows. First, the solenoid open/close valve 8 is opened when the sliding gate (not shown) is closed and the sand tank 2 is filled with the molding sand S. Then, compressed air is introduced to the inner cavities of the sealing members 6 through line H1. By this, the sealing members 6 are inflated and brought into close contact with the lips of the sand inlets 11*a*, 12*a* of the upper and the lower flasks 11, 12. When the solenoid open/close valve 8 is opened, the compressed air is also introduced to the piloted on-off valve 7 through line H2. By this, the on-off valve 7 is opened, and then the compressed air flows into the chamber 5 and the sand tank 2 via the porous member 4. As the result, the molding sand S in the sand tank 2 is fluidized and introduced into the molding spaces in the upper and the lower flasks 11, 12, through the sand filling nozzles 3*a*, 3*b* of the sand tank 2 and the sand inlets 11*a*, 12*a* of the upper and the lower flasks 11, 12.

When the solenoid open/close valve 8 is closed, the sealing members 6 are deflated and released from the lips of the sand inlets 11*a*, 12*a* of the upper and the lower flasks 11, 12. Also, when the solenoid open/close valve 8 is closed, the piloted on-off valve 7 is closed. Then, the compressed air in the sand tank 2 is exhausted to the atmosphere. The compressed air is purged into the air through a silencer mounted on the piloted on-off valve 7.

In this embodiment, the speed control valves 10*a*, 10*b* are adjusted to suitable settings. Namely, the speed control valves 10*a*, 10*b* are adjusted so that the flow rate of the compressed air through the speed control valve 10*b*, which is located between the solenoid open/close valve 8 and the sealing members 6, is greater than the flow rate through the speed control valve 10*a*, which is located between the solenoid open/close valve 8 and the piloted on-off valve 7. Such an adjustment of the speed control valves 10*a*, 10*b* enables the sealing members 6 to be inflated and come into contact with the lips of the sand inlets 11*a*, 12*a* of the upper and the lower flasks 11, 12, before the piloted on-off valve 7 is opened. Thus, when the molding spaces in the upper and the lower flasks 11, 12 are filled with the molding sand, a leakage of sand from gaps between the sand filling nozzles 3*a*, 3*b* and the sand inlets 11*a*, 12*a* of the upper and the lower flasks 11, 12 can be prevented.

As described above, the molding machine 1 of the present invention has the pair of upper and lower sand filling nozzles 3*a*, 3*b* to guide the molding sand in the horizontal direction, wherein the molding sand is supplied to the sand filling nozzles 3*a*, 3*b* from a pair of upper and lower sand introducing parts 2*a*, 2*b*, which are located at the lower part of a sand tank 2. Further, the molding machine 1 has the porous members 4, which are attached to the inner sidewall 2*c*, and the inner walls of the upper and lower sand introducing parts 2*a*, 2*b*, of the sand tank 2. This arrangement allows the following: eliminating the need to turn around a molding flask after a step of squeezing molding sand; simplifying the sand filling process; reducing the size of the molding machine, and stabilizing the sand filling operation of the molding machine by preventing the formation of a bridge and an air channel in the sand tank. In another aspect, the molding machine 1 introduces the molding sand from the pair of filling nozzles 3*a*, 3*b* to the upper and the lower flasks 11, 12 while fluidizing the molding sand in the sand tank 2 by injecting compressed air of 0.05 MPa to 0.18 MPa through the porous members 4 with a plurality of apertures that are 10 μm to 80 μm, wherein the porous members 4 are attached to the inside of the sand tank 2 so as to cover the entire inner surface where the stored molding sand may be held. By this, the formation of a stagnant part of the molding sand in the sand tank, the formation of the bridge caused by the stagnant part of the molding sand, and the formation of the air channel in the sand tank will be prevented. The formation of the stagnant part of the molding sand or the bridge or both can be prevented by using the aforementioned simplified aeration systems in place of the porous members 4.

In another aspect, the formation of the bridge or the air channel in the sand tank 2 is prevented by attaching the porous member 4 to the inner wall of the sand tank 2 so that the area covered by the porous member 4 reaches 70% to 100% of the total inner areas of the sidewall 2*c* and the upper and lower sand introducing parts 2*a*, 2*b*. Namely, a stagnant part of the molding sand tends to be formed at the upper and lower sand introducing parts 2*a*, 2*b*. This is because the sand introducing parts 2*a*, 2*b* are located at the lower part of the sand tank 2, and the direction the molding sand flows is changed by 90 degrees at the sand introducing parts 2*a*, 2*b*. The formation of the bridge or the air channel (see FIG. 6) in the sand tank 2 is prevented by injecting air through the porous member 4 to the upper and lower sand introducing parts 2*a*, 2*b*, where the stagnant part of the molding sand tends to be formed. Further, since the molding machine 1 has the porous member 4 on the inner sidewall 2*c* in addition to the lower part of the sand tank 2, the formation of the stagnant part of the molding sand or the bridge (see FIG. 5) in the sand tank 2 can be prevented by injecting air through the porous member 4 attached to the inner sidewall 2*c*. In particular, it is preferable to attach the porous member 4 to the sand filling nozzles 3*a*, 3*b* of the sand introducing parts 2*a*, 2*b*, for the following reasons. For a conventional high-pressure blowing technique, if an air-inlet nozzle is located at the sand filling nozzle, the air is mixed with molding sand, which will result in insufficient sand filling. However, by adopting a low pressure aeration technique, which injects 0.05 MPa to 0.18 MPa of compressed air through apertures that are 10 μm to 80 μm, the porous member 4 can be installed close to the pair of sand filling nozzles 3*a*, 3*b*. By this, the sand filling operation can be performed steadily, as described above.

Figure 2:
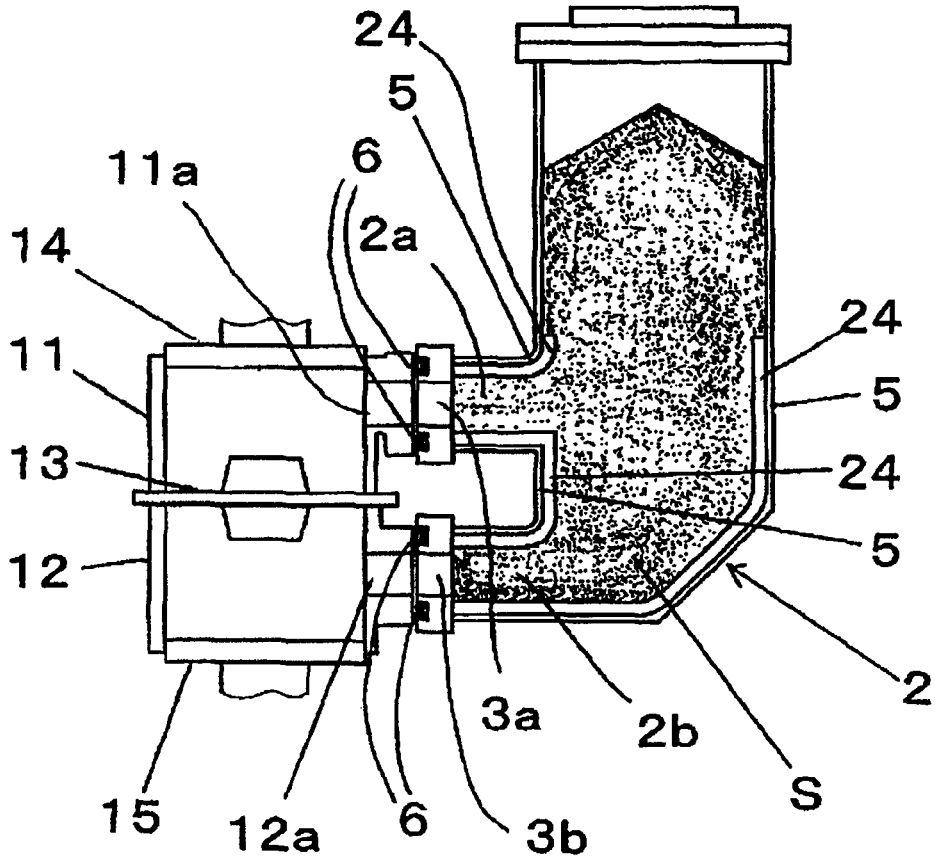
FIG. 2 illustrates the sand tank of the molding machine and associated facilities thereof, according to another embodiment, wherein 50-70% of the inner surface of the sand tank is covered by the filter part, such as a porous member.
Figure 3:
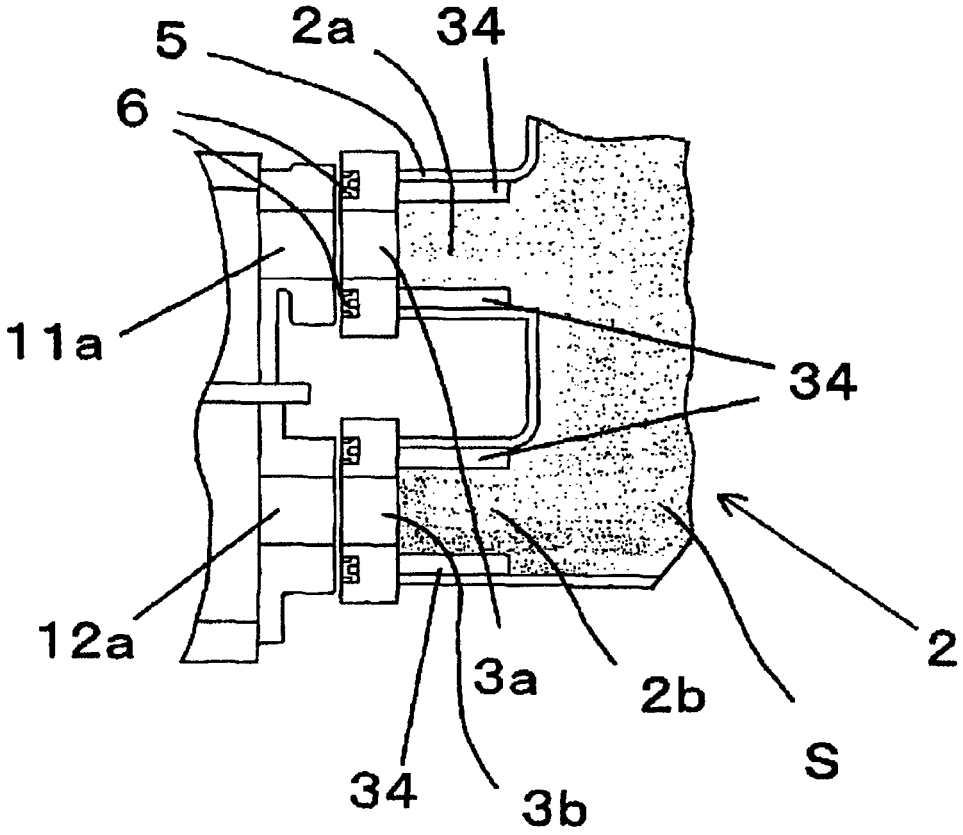
FIG. 3 illustrates the sand tank of the molding machine and associated facilities thereof, according to another embodiment, wherein the inner surfaces of the pair of sand introducing parts are covered by the filter part, such as a porous member.

The porous member 4 illustrated in FIG. 1 is attached to 70% to 100% of the inner wall of the sand tank 2. However, as illustrated in FIG. 2, to simplify the construction of the molding machine 1 as described above, the inner area of the sand tank 2 where a filter part 24 such as a porous material is to be attached can be altered to 50% to 100% of the total area of the inner sidewall 2*c* of the sand tank 2 and the inner walls of the pair of sand introducing parts 2*a*, 2*b*. Even in this simplified construction, the formation of the stagnant part of the molding sand, the bridge, or the air channel can be prevented. Even in a more simplified construction (see FIG. 3) wherein a filter part 34, such as a porous material, is attached to at least all the inner walls of the pair of sand introducing parts 2*a*, 2*b*, the formation of the air channel can be prevented. Since the construction of the molding machines of FIGS. 2 and 3 is the same as that as in FIG. 1, except for the filter parts 24 and 34, the same numerals are used, and the detailed descriptions for FIGS. 2 and 3 are omitted.

Since the molding machine 1 employs the aeration technique, the consumption of air is much lower than that consumed by a machine which employs the high-pressure blowing technique, which requires high-pressure air. Further, the noise generated during the sand filling step is reduced.

In a preferable embodiment of the molding machine 1, the volume of the upper part of the sand tank 2, which is above the pair of sand introducing parts 2*a*, 2*b*, is 1.5 times or less of the volume of the molding sand introduced to the upper and the lower flasks 11, 12. In general, the volume of the sand tank needs to be bigger than the volume of the molding sand introduced to the molding flask, so as to prevent the formation of the air channel in the sand tank. Thus, the volume of a sand tank of a conventional molding machine is generally 3 to 5 times the volume of the molding sand introduced to the molding flask. However, this is an obstacle for reducing the size the molding machine. Since the molding machine 1 of the present invention can prevent the formation of the bridge or the air channel in the sand tank even when the volume of the sand tank 2 is reduced to the aforementioned value, the size of the machine can be reduced.

In one embodiment, the molding machine 1 of the present invention prevents the formation of the bridge and the air channel, even when the amount of the molding sand introduced to the upper flask 11 from the upper sand filling nozzle 3*a* is 1.5 times or more the amount of the molding sand introduced to the lower flask 12 from the lower sand filling nozzle 3*b*. For a conventional molding machine which horizontally introduces molding sand to the sides of an upper and a lower flasks, when more molding sand is introduced to the upper and the lower flasks, an air channel would be formed in a sand tank (see FIG. 6), and therefore a sand filling operation would be interrupted. However, since the molding machine 1 of the present invention can prevent the formation of the bridge and the air channel, even when more molding sand is introduced to the upper flask 11, the molding machine 1 enables a stable sand filling operation regardless of the profile of the molding spaces formed in the upper and the lower flasks 11, 12. Needless to say, the molding machine 1 enables a stable sand filling operation, even when more molding sand is introduced to the lower flask than to the upper flask, or the same amounts of molding sand are introduced to the upper and the lower flask.

In another embodiment, the top cross-sectional view of the sand tank 2 is either rectangular or square shaped. In general, a sand tank with a rectangular or a square cross section can store more sand but tends to form a bridge in it, compared to a tank with a circular cross section. The molding machine 1 of the present invention can prevent the formation of the bridge, even when the sand tank 2 has a rectangular or a square cross section. Thus, the height of the sand tank can be lowered to reduce the size of the molding machine 1.

In the sand tank 2 of the molding machine 1, the porous member 4 is attached to the inner wall of the sand tank 2, so that a space is formed between the porous member 4 and the inner wall. The chamber 5, which is connected to the piloted on-off valve 7, is defined between the porous member 4 and the inner wall of the sand tank 2. When compressed air is exhausted from the sand tank 2, it passes through the apertures of the porous member 4. Since the porous member 4 acts as a filter, clean air (i.e., free from sand) passes through the chamber 5 and the piloted on-off valve 7. Thus, the inside of the piloted on-off valve 7 may not be contaminated with the particles of the molding sand. Since the exhaust air is free from sand, it is not necessary to have separately inlet and outlet valves, which are common in traditional molding machines. Thus, the inlet and outlet valves can be unified in the piloted on-off valve 7, which allows the reduction of the number of valves used for the molding machine 1.

In the molding machine 1, both the piloted on-off valve 7 and the inner cavities of the sealing members 6 are connected to the solenoid open/close valve 8. Namely, the lines H1 and H2 are joined together, and then connected to the piloted on-off valve 7. Thus, both the opening/closing of the piloted on-off valve 7 and the inflation/deflation of the sealing members 6 can be operated by the piloted on-off valve 7. By this, the number of valves used for the molding machine 1 is reduced.

In the aforementioned embodiment, the speed control valves 10*a*, 10*b* are provided between the solenoid open/close valve 8 and the piloted on-off valve 7, and between the solenoid open/close valve 8 and the inner cavities of the sealing members 6, respectively. However, the present invention is not limited to this embodiment. When it is possible to inflate the sealing members 6 so as to closely contact the lips of the sand inlets 11*a*, 12*a* of the upper and the lower flasks 11, 12 before opening the piloted on-off valve 7 without using the speed control valves 10*a*, 10*b*, then these speed control valves can be removed. However, by providing the speed control valves 10*a*, 10*b* between the solenoid open/close valve 8 and the piloted on-off valve 7, and between the solenoid open/close valve 8 and the inner cavities of the sealing members 6 respectively, without fail the sealing members 6 inflate before opening the piloted on-off valve 7, and contact the lips of the sand inlets 11*a*, 12*a* of the upper and the lower flasks 11, 12.

Although the molding machine 1 of the aforementioned embodiment has one piloted on-off valve 7, the present invention is not limited to it. The number of the piloted on-off valves can be two or more, depending on the size of the sand tank 2. When two or more piloted on-off valves are used, all are connected to the solenoid open/close valve 8. By doing so, all the piloted on-off valves are activated simultaneously by the solenoid open/close valve 8.

Figure 4:
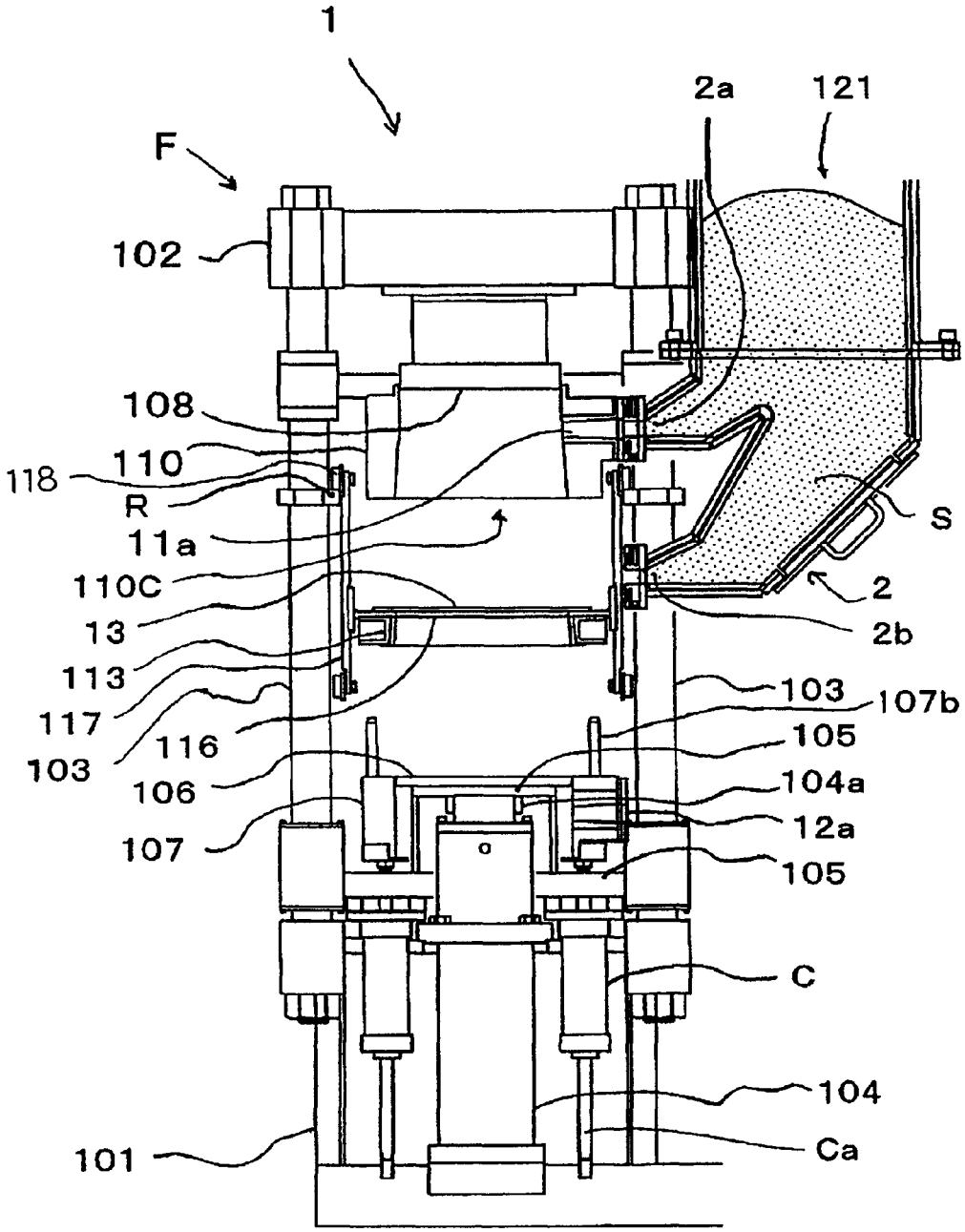
FIG. 4 illustrates the configuration of the molding machine according to the present invention.
Figure 5:
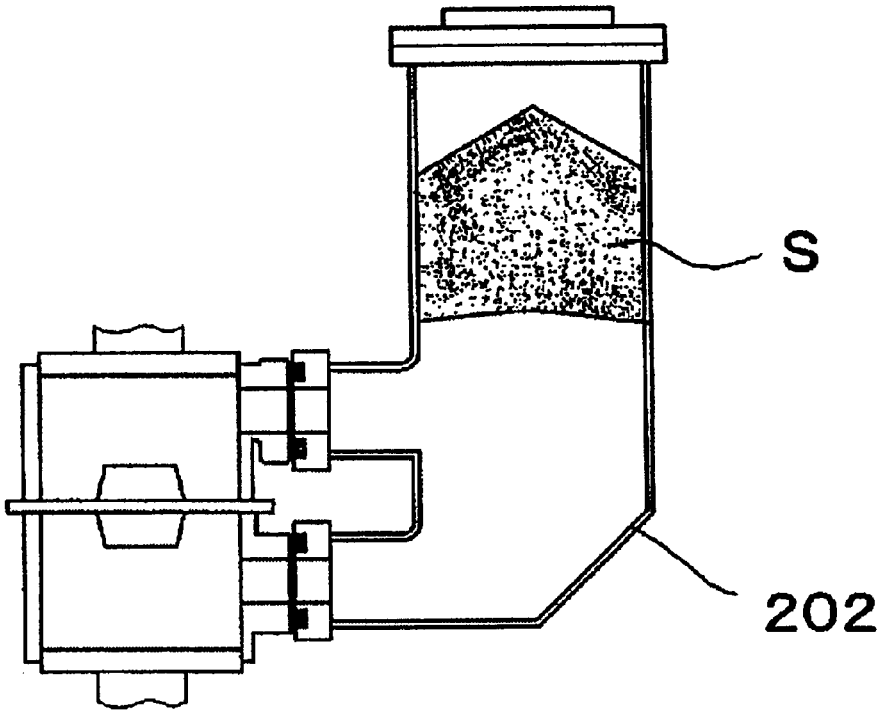
FIG. 5 is a cross-sectional view to illustrate the formation of a bridge in a sand tank of a conventional molding machine.
Figure 6:
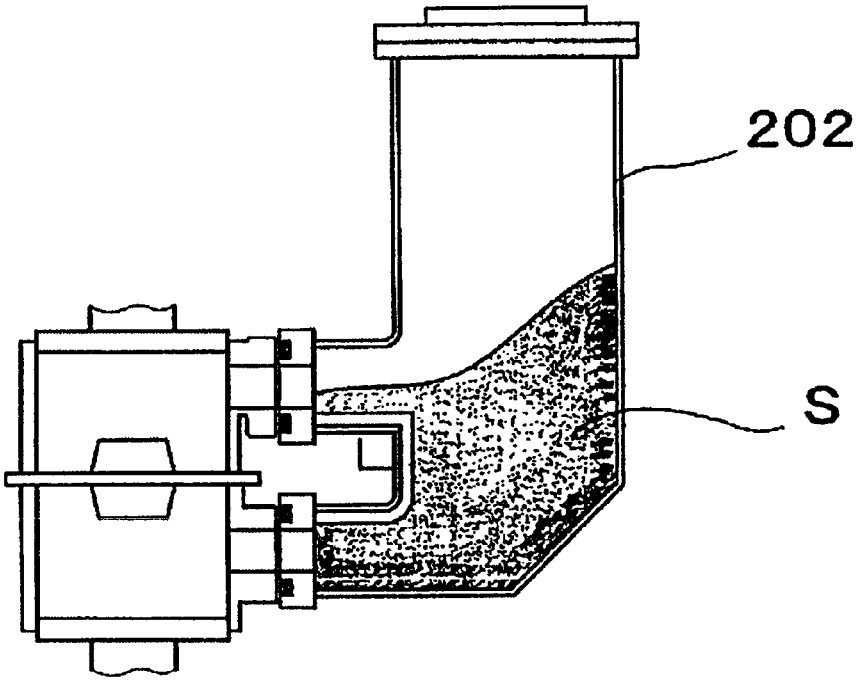
FIG. 6 is a cross-sectional view to illustrate the formation of an air channel in a sand tank of a conventional molding machine.

The construction and other features of the molding machine 1 of the present invention are further clarified by the following descriptions, with reference to FIG. 4, which is a front elevation view of the status just before a sand filling operation starts.

As illustrated in FIG. 4, the molding machine 1 comprises the following: a lower squeeze board 106, which is movable up and down; a lower filling frame 107, which is movable up and down independently of but simultaneously with the lower squeeze board 106, and that is provided with a sand-introducing hole 12*a* formed on the sidewall of the flask 107; an upper squeeze board 108, which is fixed above the lower squeeze board 106 so as to be opposed to the lower squeeze board 106; and a cope flask 110, which is movable up and down and provided with a sand-introducing hole 11*a* formed on the sidewall of the flask 110; a drag flask 113, which is provided with a match plate 13 on the top of it, and movable to and from an intermediate position between the upper and lower squeeze boards 106, 108. The molding machine 1 is a so called flaskless molding machine.

As used herein, the phrase "movable up and down independently of but simultaneously with" means that only the lower filling frame is moved up and down by a lower filling frame cylinder independently of the lower squeeze board, but the lower filling frame is moved up and down together with the lower squeeze board when a flask-set-squeeze cylinder moves the lower squeeze board up and down. In FIG. 4, the lower squeeze board can move down independently of the lower filling frame. The upper squeeze member 14, the lower squeeze member 15, and the upper and the lower flasks 11, 12 illustrated in FIG. 1 are all depicted in more detail in FIG. 4. In this embodiment, the combination of the lower filling frame 107 and the drag flask 113 can act as the lower flask 12 as in FIG. 1, and the cope flask 110 can act as the upper flask 11.

The gate-type frame F illustrated in FIG. 4 comprises a lower base frame 101 and an upper frame 102, which are connected by four columns 103. A flask-set-squeeze cylinder 104 is fixed in an upward direction at the center of the lower base frame 101. The lower squeeze board 106 is mounted on the distal end of the piston rod 104*a* of the flask-set-squeeze cylinder 104 via the lower squeeze frame 105. Sliding bushes whose diameters are at least 10 mm are embedded at the corners of the lower base frame 101, to maintain the lower squeeze frame 105 in a horizontal position. The flask-set-squeeze cylinder 104, which is located at the center of the lower squeeze frame, is surrounded by four lower filling frame cylinders C. The lower filling frame 107 is mounted on the distal ends Ca of the lower filling frame cylinders C. At the center of the lower squeeze frame 105, a hole is provided to put through the flask-set-squeeze cylinder 104.

The lower filling frame 107 is formed so that the distance between the opposing inner walls decreases as measured from the top to the bottom of the lower filling frame. Further, the lower filling frame 107 has a sand inlet 12*a* on the sidewall thereof, and an opening which is formed so as to be able to insert the lower squeeze board 106 airthightly.

The lower squeeze board 106 is integrated with the lower squeeze frame 105. Thus, when the lower squeeze board 106 is pushed up by the flask-set-squeeze cylinder 104, the lower squeeze frame 105 is pushed up together with the four lower filling frame cylinders C. The lower filling frame cylinder C is operable independently of but simultaneously with the flask-set-squeeze cylinder 104. Thus, a lower squeeze unit, which includes the lower squeeze board and the lower squeeze frame, is movable up and down in an integrated manner, wherein the lower filling frame is mounted on the distal ends of two or more upwardly directing lower filling frame cylinders which are fixed on the lower squeeze frame which is movable up and down along two or more columns. On the top side of the lower filling frame 107, positioning pins 107*b* are provided.

The upper squeeze board 108, which is above the lower squeeze board 106 and opposite the lower squeeze board 106, is fixed on the bottom side of the upper frame 102. The cope flask 110 is formed so that the distance between the opposing inner walls increases as measured from the top to the bottom of the flask. Further, the cope flask 110 has a sand inlet 11*a* on the sidewall thereof, and an opening which is formed so as to be able to insert the upper squeeze board 108 airthightly. The cope flask 110 is mounted on a cope flask cylinder (not shown) which is fixed on the upper frame 102 in the downward direction.

The gap between the upper squeeze board 108 and the lower squeeze board 106 is big enough to insert a drag flask 113. Guide rails R extend in a front-back direction between columns 103. A match plate 13, which has patterns on both sides, is attached to the top side of the a drag flask 113 with the aid of a master plate 116, which is between the match plate 13 and the drag flask 113. Flanged rollers 118 are attached to the four corners of the drag flask 113 with the aid of roller-arms 117. The sand tank 2 is designed to be used with a so called low pressure aeration technique wherein compressed air of a relatively low pressure, i.e., ranging from 0.05 MPa to 0.18 MPa, is employed for a sand filling operation. The sand tank 2 has the pair of sand introducing parts 2*a*, 2*b*, which are formed by dividing the bottom part of the sand tank 2 into two parts which lead in different directions, and a sand-gate (not shown) with a molding sand feeding port 121 on the upper part of the sand tank 2.

The molding machine illustrated in FIG. 4 is operated as follows. First, the flanged rollers 118 are engaged with the guide rails, and then the drag flask 113, to which the match plate (pattern plate) 13 is tightly attached together with the master plate 116, is inserted in a predetermined position between the lower squeeze board 106 and the upper squeeze board 108.

Then, the lower filling frame 107 and the lower squeeze board 106 are pushed up by upward expansions of both the lower filling frame cylinder C and the flask-set-squeeze cylinder 104, so that the positioning pins 107*b* are pushed in the drag flask 113 and the match plate 13. By this operation, a lower sealed space is formed. Next, the lower filling frame 107, the lower squeeze board 106, the drag flask 113 and the match plate 13 are pushed up in an integrated manner so that the positioning pins 107*b* are pushed into the bottom side of the cope flask 110. By this operation, the match plate 13 and the master plate 116 are sandwiched between the drag flask 113 and the bottom side of the cope flask 110, resulting in the formation of an upper sealed molding space. At this stage, the sand inlet 12*a* of the lower filling frame 107 is aligned with the sand introducing part 2*b* of the sand tank 2.

By feeding compressed air to the sand tank 2 while closing the sand-gate, the molding sand S in the sand tank 2 is introduced to the upper and lower sealed spaces through the sand inlet 11*a* of the cope flask 110 and the sand inlet 12*a* of the lower filling frame 107. Only air is discharged into the atmosphere through exhaust holes formed on the sidewalls of the cope flask 110 and the drag flask 113.

Then, the lower filling frame 107, the drag flask 113, the match plate 13, and the cope flask 110 are moved up by the expansion of the flask-set-squeeze cylinder 104. Further, the molding sand S in the upper and lower sealed spaces is squeezed by activating the upper and lower squeeze boards 106, 108.

After squeezing the molding sand, the lower squeeze board 106 is lowered by the contraction of the flask-set-squeeze cylinder 104, while the drag flask 113, the match plate 13, and the master plate 116, are all suspended on the guide rails R with the aid of the flanged rollers 118.

The flask-set-squeeze cylinder 104 is retracted to its home position and then stopped. The lower filling frame 107 is maintained at the position where the squeezing of the molding sand is completed, but the lower squeeze board 106 is lowered to its home position by the contraction of the flask-set-squeeze cylinder 104.

By pulling back the drag flask 113, the match plate 13, and the master plate 116 from the gap between the cope flask 110 and the lower filling frame 107, the lower mold in the lower filling frame 107 becomes ready to be put on a core, although the core is not always needed.

When the core is placed on the lower mold (if necessary), the lower squeeze board 106 is moved up by the expansion of the flask-set-squeeze cylinder 104. By this, the lower mold in the lower filling frame 107 contacts the upper mold in the cope flask 110. Then, the upper mold is stripped from the cope flask 110 by moving up the cope flask 110 with the cope flask cylinder (not shown).

In this step, since the force to lift the flask-set-squeeze cylinder 104 is set to be lower than the force to squeeze the molding sand, the upper and lower molds may not be crushed. After stripping the upper mold, the squeeze board 106 is lowered by the contraction of the flask-set-squeeze cylinder 104, and then the lower filling frame 107 is lowered by the contraction of the lower filling frame cylinder C, to strip the lower mold from the lower filling frame 107. As a result, the upper and lower molds become ready to be transferred. The upper and lower molds sitting on the squeeze board 106 are transferred to a conveying line by a pusher (not shown).

Since the lower squeeze board 106 of the molding machine 1 is integrated with the lower squeeze frame 105, which is movable up and down along the four columns, the lower squeeze board 106 is not slanted even when the patterns are eccentrically located on the pattern plate 115. Accordingly, the molding machine 1 can steadily produce desirable molds with flat bottoms. Further, since the lower filling frame 107 is movable up and down with the lower squeeze board 106 in an integrated manner, the construction of the molding machine 1 can be simplified.

Although the molding machine 1 of the aforementioned embodiment has four columns, two or more columns are sufficient to achieve the advantageous effect of the present invention. Four columns are particularly preferable, as the cross-sectional shape formed by the columns is analogous to that of the mold, and therefore the force on the columns is well balanced. With two columns, the number of columns can be advantageously minimized.

The cylinders of the molding machine 1 can be air cylinders or electric actuators or both. The columns are surface-treated so that the bushes for the lower squeeze frame slide along the columns. Further, the columns are connected to the base frame, and the bottom ends of the columns are located above a floor. By this, the bending of the columns is prevented. Further, the cost for the expensive surface-treatment is saved. Further, the length of the bushes, which are provided at the four corners of the lower squeeze frame, is preferably 50 mm or more, to maintain the bushes parallel to each other. By this, the lower squeeze frame is oriented horizontally. In the molding machine 1, the cross-sectional shape of the lower squeeze frame is rectangular, with a convexity in the middle. The convexity has a void, and the flask-set-squeeze cylinder and the piston rod are projected from the lower side. The shape of the convexity can be a trapezoid. The height of the molding machine can be reduced by the void in the convexity. The lower filling frame cylinder can be either a one-sided cylinder or a two-sided cylinder.

The present invention is not limited to the aforementioned embodiments, but is applicable to any molding machines for molding molds.

The invention claimed is:

1. A molding machine comprising:

a sand tank for storing molding sand to be introduced through a side wall of a molding flask in a horizontal direction;

a pair of upper and lower sand filling nozzles for introducing the molding sand in the horizontal direction through the side wall of the molding flask, a pair of horizontally extending upper and lower sand introducing parts, which are connected to a lower part of the sand tank and the nozzles, for supplying the molding sand from the sand tank to the nozzles;

and at least one filter part with a plurality of air-injecting apertures on an entire body of the at least one filter part, which at least one filter part is attached to at least an entire inner surface of each of the pair of sand introducing parts and is adjacent to the nozzles;

wherein molding sand in the sand tank and in the pair of sand introducing parts is fluidized by air injected through the air-injecting apertures of the at least one filter part, which is attached to at least the entire inner-surface of each of the pair of sand introducing parts, and introduced into the molding flask through the sand filling nozzles, wherein the at least one filter part comprises a porous member which has a plurality of air injecting apertures with pore diameters of from 10 μm to 80 μm, wherein the molding machine has an air-control valve, which is connected to chamber formed between an inner surface of the sand tank and the porous member, to control both the charging and discharging of compressed air to the air chamber, wherein the molding machine has sealing members which are attached to lips of the sand filling nozzles and inflated by compressed air supplied to inner cavities of the sealing members and on-off valves which are connected to the air-control valve and the inner cavities of the sealing members, and wherein the molding machine has speed control valves which are installed between the on-off valves and the air-control valve, and between the on-off valves and the inner cavities of the sealing members.

2. The molding machine of claim 1, wherein pressure of the air which is injected through the air injecting apertures of the porous member is from 0.05 MPa to 0.18 MPa.

3. The molding machine of claim 1, wherein the at least one filter part is attached to an inner sidewall of the sand tank and the entire inner surfaces of each of the pair of sand introducing parts, wherein an area to attach the filter part is 50% to 100% of a total area of the inner sidewall of the sand tank and the inner surfaces of the pair of sand introducing parts.

4. The molding machine of claim 3, wherein an area to attach the filter part is 70% to 100% of the total area of the inner sidewall of the sand tank and the inner surfaces of the pair of sand introducing parts.

5. The molding machine of claim 4, wherein a volume of an upper part of the sand tank, which is above the connection of the pair of upper and lower sand introducing parts, is 1.5 times or less of a volume of the molding sand introduced into the molding flask.

6. The molding machine of claim 5, wherein an amount of the molding sand introduced into the molding flask from the upper sand filling nozzle is 1.5 times or more of an amount of the molding sand introduced into the molding flask from the lower sand filling nozzle.

7. The molding machine of claim 5, wherein a cross-sectional shape of the sand tank is either rectangular or square.

8. The molding machine of claim 1, wherein the molding flask comprises a cope flask and a drag flask in which a pair of flaskless upper and lower molds made of molding sand are molded, and the molding machine includes:

a lower squeeze board which is movable up and down;

a lower filling frame which is movable up and down independently of but simultaneously with the lower squeeze board, and provided with a sand introducing hole formed on a sidewall thereof;

an upper squeeze board which is opposed to the lower squeeze board and located above the lower squeeze board;

the cope flask which is movable up and down and provided with a sand introducing hole formed on a sidewall thereof;

the drag flask which is provided with a match plate on a top of the drag flask, and movable to and from an intermediate position between the upper and lower squeeze boards; and a lower squeeze frame which is integrated with the lower squeeze board and movable up and down along two or more columns.

9. The molding machine of claim 8, wherein the lower filling frame is mounted on distal ends of rods of two or more lower filling frame cylinders which are fixed on the lower squeeze frame in an upward direction.

10. The molding machine of claim 9, wherein the lower squeeze board is moved up and down by an air-on-oil.

11. The molding machine of claim 10, wherein the lower filling frame is moved up and down by a pneumatic or an electrical driving force.

12. The molding machine of claim 11, wherein the cope flask is moved up and down by an actuator, when a molded sand mold is stripped off from the cope flask.

* * * * *